US006936316B2

(12) United States Patent
Nigam et al.

(10) Patent No.: US 6,936,316 B2
(45) Date of Patent: Aug. 30, 2005

(54) INK-JET RECORDING MEDIUM WITH AN OPAQUE OR SEMI-OPAQUE LAYER COATED THEREON, METHOD FOR RECORDING AN IMAGE, AND A RECORDED MEDIUM WITH AT LEAST ONE LAYER RENDERED CLEAR OR SEMI-OPAQUE

(76) Inventors: Asutosh Nigam, 4506 Amiens Ave., Freemont, CA (US) 94110; Ravi Renduchintala, 575 S. Rengstorff Ave. #27, Mountain View, CA (US) 94040

( * ) Notice: Subject to any disclaimer, the term of this patent is extended or adjusted under 35 U.S.C. 154(b) by 0 days.

(21) Appl. No.: 10/314,855

(22) Filed: Dec. 9, 2002

(65) Prior Publication Data

US 2004/0109958 A1 Jun. 10, 2004

(51) Int. Cl.[7] ..... B41M 5/40

(52) U.S. Cl. ..... 428/32.17; 428/32.21; 428/32.25; 428/32.26; 428/32.34

(58) Field of Search ..... 428/32.17, 32.21, 428/32.25, 32.26, 32.34

(56) References Cited

U.S. PATENT DOCUMENTS 6,723,383 B2 * 4/2004 Nigam ..... 427/261
2001/0051217 A1 12/2001 Nigam ..... 427/256
2004/0202832 A1 * 10/2004 Nigam et al. ..... 428/195.1

* cited by examiner

*Primary Examiner*—B. Shewareged

(57) ABSTRACT

The present invention features a multi-layer ink-jet recording medium, suitable for recording images with dye and pigmented inks and thereby providing light-emitting, reflective, glossy, metallic-looking or holographic images, comprising a substrate coated with at least two layers comprising:

(a) a first transparent ink-receptive layer comprising a polymeric binder and a cross-linker and optionally having a plasticizer and pigment particles such as alumina and silica coated over the substrate, wherein the cross-linker comprises and azetidinium polymer or a salt thereof, and/or a polyfunctinal aziridine or a salt thereof or a polyfunctional oxazoline or a salt thereof; and (b) a second ink-receptive layer comprising an opaque or semi-opaque coating composition, wherein the opaque or semi-opaque coating composition is capable of accepting a printed image and thereby becoming semi transparent or clearly transparent from application of ink-jet printing ink or similar inks, while presenting a light-emitting, reflective, glossy, metallic-looking or holographic image of high clarity and quality, wherein said first layer is located between said second layer and the substrate in said recording medium and the first and second layers are chemically coupled.

58 Claims, No Drawings

INK-JET RECORDING MEDIUM WITH AN OPAQUE OR SEMI-OPAQUE LAYER COATED THEREON, METHOD FOR RECORDING AN IMAGE, AND A RECORDED MEDIUM WITH AT LEAST ONE LAYER RENDERED CLEAR OR SEMI-OPAQUE

TECHNICAL FIELD

The present invention relates generally to an ink-jet recording medium having at least two layers coated upon a substrate such as paper, one layer of which is opaque or semi-opaque and the other is transparent or semi-transparent and the two layers are chemically coupled. The invention more particularly relates to a novel ink-jet recording medium and method for recording a water-resistant image on the medium using an ink-jet printer to render the at least one opaque or semi-opaque layer clear or semi-opaque such that an image or text is recorded upon the medium, and the resulting medium having a recorded image.

BACKGROUND

As printing technology advances, paper manufacturers (or manufacturers of other printable substrates) are faced with the increasingly rigorous demands of their customers for high quality printable substrates that are economically attractive. For example, there is a great demand for printable substrates having an opaque or semi-opaque outer layer on their surface that can be rendered clear or semi-opaque to produce a printed medium that is useful in advertising and/or for producing attractive labels on products. Particularly needed are printable substrates with high enough quality to be suitable for printing of a digital image with an ink-jet printer, wherein the outer layer of the substrate is capable of being rendered either semi-opaque or clear is constructed upon a clear, semi-opaque, colored, or a reflective substrate layer (such as a metallic looking reflective substrate layer).

There is a keen demand for substrates that meet high quality standards with respect to brightness, opacity, and dry and/or wet strength, and that, upon printing with any of a wide range of colorants, provide a water-resistant printed image. The ability of such substrates to yield a printed substrate having high resolution and clarity without bleeding or mottling of the image, even when using ink jet printing has become in very high demand. Also, such substrates need to have appropriately smooth or textured surfaces that can be easily received by a non-impact printing system and to avoid curling surfaces that can clog printing equipment. Customers further demand that such substrates be amenable to use with a variety of printing techniques, including not only conventional printing techniques, but also "impact free" printing techniques such as inkjet printing (particularly colored inkjet printing), laser printing, photocopying, and the like.

In one market area such substrates are particularly desired that have the ability to produce a metallic-looking image on the substrate, and perhaps even a holographic image. In another market area, there is needed clear base substrates with a printed image that can be used with a projector for presentations. Also, clear base substrates having an adhesive backing for applying to articles of commerce are particularly in demand. A particularly high demand is for holographic labeling, since this is very difficult and expensive to produce and can be in high demand if an appropriate quality label can be produced.

Published U.S. patent application Ser. No. 2001/0051217 A1 (hereinafter 51217 application) relates to a process for producing a light-emitting, glossy, reflective or metallic-looking image utilizing opaque coating compositions on a reflective, glossy, or luminescent substrate wherein the original surface of the substrate is initially masked but, after contact with a recording liquid, becomes transparent, revealing the glossy, reflective or luminescent substrate through the contacted, coated area. The opaque coating compositions are composed of a mixture of a polyacid and a polybase and may be used to treat a substrate either during or after manufacture. Substrates treated with the present opaque coating compositions can be used to yield high quality light-emitting, glossy, reflective, or metallic-looking images.

However, the process, compositions and substrates described in the 51217 application suffered from a number of serious drawbacks and disadvantages that made their manufacturing and use not so desirable. The single layer composition of the substrate (or multiple coats of the single composition) and the make-up of the composition created a slow drying time after application of the image to substrate. The surface of the substrate (that was manufactured and printed as described in the 51217 application) can remain tacky for ten minutes up to several hours, which means that printing multiple copies, or multiple pages, can cause the tacky pages to adhere together and mar the printed substrate. A commercially viable product needs to dry from immediately up to a very few minutes. In addition, the 51217 substrate could allow bleeding on several types of the most commonly used printers or dispersion of the printed image that led to poor resolution in printed images. Also, when the layer was thick enough to avoid bleeding, it would sometime not become adequately transparent upon printing of an image.

There is a need for improving substrates have an initially opaque coating (or similar coatings) such as those described in the 51217 application in order, but without the drawbacks and disadvantages described above, in order to provide a printed substrate having an improved resolution and clarity without bleeding or mottling of the image, even when using ink jet printing device. There is a need to have printable substrates that have improved drying times to avoid excessively tacky surfaces and undesired adhering of multiple sheets. Also, there is a need to provide improved substrates from many different types of starting substrates (base substrates) having an initial base coating that will adhere well to a variety of such substrates and yet still accept coatings of the initially opaque (or semi-opaque) layers similar to those described in the 51217. There is a need to thereby provide light-emitting, reflective, glossy, metallic-looking or holographic images on a wide variety of substrate types and products, particularly as rolls, cut sheets, and labels for articles of commerce.

Accordingly, there is a need in the art for a simple and inexpensive process for the printing of light-emitting, reflective or metallic-looking glossy, metallic-looking or holographic images on a wide variety of substrate types and products, which have acceptable drying times and improved image clarity.

OBJECTS OF THE INVENTION

It is an object of the present invention to provide an ink-jet recording medium having at least two layers coated upon a substrate such as paper, one layer of which is opaque or semi-opaque that has improved drying times after printing as compared to substrates coated with a single layer type to avoid excessive adhering of multiple sheets. More particularly, an object of the invention is to provide a novel ink-jet recording medium and method for recording a water-resistant image on the medium using an ink-jet printer to render at least one opaque or semi-opaque layer clear or semi-opaque such that an image or text is recorded upon the medium, and the resulting recorded medium.

In another object, the present invention provides compositions and methods for preparing images on substrates, wherein an outer layer of the substrate is initially opaque and a layer of the substrate located under the outer layer can be metallic, clear, colored or light reflective, and the outer layer of the substrate is constructed to permit the outer layer to be contacted with a recording medium such as ink and thereby rendering the outer layer of the substrate progressively translucent or clear in order to display the characteristics of the under lying layer. More particularly, it is an object of the invention to provide compositions and methods for preparing clear, light-emitting, highly reflective, semi-opaque, and/or metallic-looking images on clear, glossy, light-emitting, highly reflective, semi-opaque or luminescent substrates.

In another object, the invention also provides substrates that can be quickly printed without excessive adhering of multiple sheets, wherein the substrates have clear, light-emitting, highly reflective, semi-opaque and/or metallic looking images thereon.

A further object of the present invention is to provide a multi-layer ink-jet recording medium, suitable for recording images with dye and pigmented inks and thereby providing light-emitting, reflective, glossy, metallic-looking or holographic images, comprising a substrate coated with at least two layers comprising:

(a) a first transparent ink-receptive layer comprising a polymeric binder and a cross-linker and optionally having a plasticizer and pigment particles such as alumina and silica coated over the substrate, wherein the cross-linker comprises and azetidinium polymer or a salt thereof, and/or a polyfunctional aziridine or a salt thereof or a polyfunctional oxazoline or a salt thereof, and (b) a second ink-receptive layer comprising an opaque or semi-opaque coating composition, wherein the opaque or semi-opaque coating composition is capable of accepting a printed image and thereby becoming semi transparent or clearly transparent from application of ink-jet printing ink or similar inks, while presenting a light-emitting, reflective, glossy, metallic-looking or holographic image of high clarity and quality, wherein said first layer is located between said second layer and the substrate in said recording medium and the first and second layers are chemically coupled.

In one aspect, it is an object of the present invention to provide an ink-jet recording medium as described above, wherein the cross-linker of the first ink-receptive layer comprises an azetidinium polymer salt comprising monomer units having the structural formula:

(I)

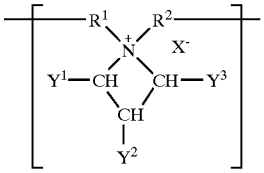

in which $R^1$ and $R^2$ are independently lower alkylene, $X^-$ is an anionic, organic or inorganic counterion, and $Y^1$, $Y^2$ and $Y^3$ are selected from the group consisting of hydrogen, hydroxyl, halo, alkoxy, alkyl, amino, carboxy, acetoxy, cyano and sulfhydryl, and the cross-linker of the first ink-receptive layer further comprises a polyaminoamide epichlorohydrin resin, or a salt thereof.

Another object of the invention is to provide a commercially acceptable method for producing a light-emitting, glossy, reflective or metallic-looking image comprising the steps of applying at least two different layers of coating compositions to a substrate, wherein at least one of the layers is an opaque coating composition and at least one surface of the substrate to which the layers are applied is a light emitting, glossy, reflective or luminescent substrate, and contacting the coated substrate with a recording liquid, wherein the opaque coating comprises a mixture of an ammonium polyacid salt and a polybase.

Another object of the invention is to provide improved opaque coatings for the treatment of glossy, reflective or luminescent substrates, which provide a light emitting, glossy, reflective or luminescent surface when contacted with a recording liquid without excessive drying time and undesired tackiness.

A further object of the invention is to provide an opaquely coated reflective or luminescent substrate wherein the opaque coating provides a light-emitting, reflective, glossy, metallic-looking or holographic image when contacted with a recording liquid.

Other objects, advantages and novel aspects of the invention will be apparent by reviewing the disclosure below and the appended claims, or may be readily learned by practice of the invention as set forth below.

DEFINITIONS AND NOMENCLATURE

It must be noted that, as used in the specification and the appended claims, the singular forms "a," "an" and "the" include plural referents unless the context clearly dictates otherwise. Thus, for example, reference to "a monomeric amine compound, a bisamine compound or an amine oligomer" in a composition means that more than one amine compound or oligomer or more then one bisamine compound, or a mixture thereof, can be present in the composition, reference to "a film-forming binder" in a composition means that more than one film-forming binder can be present in the composition, reference to "an amine oligomer or bisamine compound" includes combinations of different amine oligomers as well as mixtures of amine compounds or a combination thereof, reference to "a coating agent' includes mixtures of different coating agents, and the like.

The term "paper" or "paper substrate" with reference to the ink-jet recording medium is meant to encompass any substrate based on cellulosic fibers; synthetic polymer films and fibers such as polyamides, polyesters, polyethylene, and polyacrylic; inorganic fibers such as asbestos, ceramic, and glass fibers; and any combination of cellulosic, synthetic, and inorganic fibers or a combination of cellulosic fiber and synthetic polymer films produced by extrusion or coating the cellulosic fiber substrate. The paper or paper substrate can be composed of compressed natural or synthetic fibers, of compressed natural or synthetic solids, or of a woven appearance such as a textile or canvas. The paper or paper substrate may be an opaque or a see-through substrate such as used with an overhead projector, and the substrate may be of any dimension (e.g., size or thickness) or form (e.g., pulp, wet paper, dry paper, etc.). Also, the paper or paper substrate can have a smooth or textured appearance, e.g., a canvas-look texture. In most instances, the "paper" or "paper substrate" has been subjected to an external sizing process prior to treatment according to the methods of the invention, however sizing is not required. The paper substrate is preferably in the form of a flat or sheet structure, which structure may be of variable dimensions (e.g., size and thickness). "Paper" is meant to encompass printing paper (e.g., inkjet printing paper, etc.), writing paper, drawing paper, and the like, as well as board materials such as cardboard, poster board, Bristol board, and the like.

The term "sheet" or "flat structure" is not meant to be limiting as to dimension, roughness, or configuration of the substrate useful with the present invention, but rather is meant to refer to a product suitable for coating. A sheet or flat structure can refer to a substrate having either a substantially smooth or a textured appearance, e.g., a canvas-look texture.

"Sized paper substrate" is a paper substrate as described above that has applied to its surface and/or is saturated with a sizing composition. Sizing compositions may be applied in an internal sizing step and/or in an external sizing step; preferably sizing (e.g., internal and/or external sizing) occurs prior to application of the coating composition of the invention.

"Coated paper substrate" is a paper substrate that has applied to its surface and/or is saturated with a coating composition of the invention. Coating compositions may be applied as a pre-treatment (e.g., prior to printing), simultaneously with printing, or as an after-treatment. The coating compositions of the invention are applied in quantities suitable to provide the desired characteristics, such as bleed resistance, water resistance (e.g., water-fastness) of an ink printed on coated paper substrate, etc. Multiple coatings may be applied, but one embodiment consists of a single application of the coating composition on one or both sides of a substrate to produce a high quality coated paper substrate.

"Reflective substrate" refers to a substrate having at least one side providing metallic or metallic-like reflection. Such a reflective substrate is prepared, for example, by laminating a metal foil, or by the deposition of a metallic layer (or metallic-like layer) on a paper, film or other suitable substrate.

"Aqueous based ink" refers to an ink composed of an aqueous carrier medium (or composed of a mixed solvent medium such as a mixture of aqueous and aqueous miscible organic solvents) and a colorant, such as a dye or a pigment dispersion. An "aqueous carrier medium" is composed of water or a mixture of water and one or more water-soluble organic solvents. Exemplary aqueous based ink compositions are described in detail below.

"Colorant" as used herein is meant to encompass one or more organic dyes, inorganic dyes, pigments, stains, and the like compatible for use with the polymer coatings of the invention. A colorant may be in the RGB scale, the CMY scale, or simply a white or black opaque pigment. Examples of opaque pigments are aluminas, silicas, and titanium oxide. Examples of organic pigments are micronized organic polymers that are usually not soluble in water.

The term "organic solvent" is used herein in its conventional sense to refer to a liquid organic compound, typically a monomeric organic material in the form of a liquid, preferably a relatively non-viscous liquid, the molecular structure of which contains hydrogen atoms, carbon atoms, and optionally other atoms as well, and which is capable of dissolving solids gases or liquids.

The terms "significant" or "significantly", as when used with reference to "significantly enhanced brightness" or "significantly improved water-fastness" generally refer to a difference in a quantifiable, measurable, or otherwise detectable parameter, e.g., optical density, LAB graphs (color sphere), dot spread, bleed through, between the two groups being compared (e.g., uncoated versus coated paper substrates) that is statistically significant using standard statistical tests. For example, the degree of visual wicking or water-fastness in a coated paper substrate as detected in a print assay may be quantified using standard methods, and the degree of wicking or water-fastness under different conditions can be compared for both coated and uncoated paper substrates to detect statistically significant differences.

Photograph-like quality "look and feel", when used herein refers to a printed substrate wherein the image is substantially free of the type of speckling or graininess that is usually caused by uneven absorption (or by incomplete absorption) of water soluble inks into the substrate after printing and before drying, and may be glossy, dull or semi-glossy in appearance based upon the desired result and the desired coating composition.

The terms "opaque", when used herein refer to a material that is not transparent (but may optionally have a uniform color, multiple colors, or particles of color) and images cannot be seen through it at all, or only slightly and not clearly, while the term "semi-opaque" refers to a material that is only slightly translucent such that it may have a milky appearance or show printed material in a fuzzy focus sort of way.

The term "fluid resistance" is used herein to describe the resistance of a paper substrate to penetration by a fluid, with the term "water resistance" specifically referring to resistance of a paper substrate to penetration by a fluid.

The term "water-fast," is used herein to describe a form of water resistance, and which is normally used to refer to the nature of the ink composition after drying on a substrate. In general, "water-fast" means that the dried composition is substantially insoluble in water, such that upon contact with water, the dried ink retains at least about 70%, preferably at least about 85%, and more preferably at least about 95%, of optical density.

The term "bleed resistance" is meant to refer to the retardation of the penetration of water into paper, which retardation is associated with creation of a low energy hydrophobic surface at the fiber-water interface which increases the contact angle formed between a drop of liquid and the surface, and thus decreases the wettability. Contact angles have been shown to be sensitive to molecular packing, surface morphology, and chemical constitution of the paper substrate and any components added thereto.

The term "rub resistance" is normally meant to refer to a characteristic of the ink composition after drying on a substrate, more specifically, the ability of a printed image to remain associated with the substrate upon which it is printed despite application of force (e.g., rubbing) to the printed image. In general, "rub resistant" means that the dried ink composition is substantially resistant to rubbing force so that the dried ink retains at least about 70%, preferably at least about 85%, and more preferably at least about 95%, of optical density after rubbing of the printed image.

The term "alkyl" as used herein refers to a branched or unbranched saturated hydrocarbon group of 1 to 24 carbon atoms, such as methyl, ethyl, n-propyl, isopropyl, n-butyl, isobutyl, t-butyl, octyl, decyl, tetradecyl, hexadecyl, eicosyl, tetracosyl and the like, as well as cycloalkyl groups such as cyclopentyl, cyclohexyl and the like. The term "lower alkyl" intends an alkyl group of 1 to 6 carbon atoms, preferably 1 to 4 carbon atoms.

The term "alkylene" as used herein refers to a difunctional, branched or unbranched saturated hydrocarbon group of 1 to 24 carbon atoms, including without limitation methylene, ethylene, ethane-1,1-diyl, propane-2,2-diyl, propane-1,3-diyl, butane-1,3-diyl, and the like. "Lower alkylene" refers to an alkylene group of 1 to 6 carbon atoms.

The term "alkoxy" as used herein intends an alkyl group bound through a single, terminal ether linkage; that is, an "alkoxy" group may be defined as—OR where R is alkyl as defined above. A "lower alkoxy" group intends an alkoxy group containing 1 to 6 carbon atoms.

"Halo" or "halogen" refers to fluoro, chloro, bromo or iodo, and usually relates to halo substitution for a hydrogen atom in an organic compound.

The term "polymer" is used herein in its conventional sense to refer to a compound having about 8 or more monomer units, and unless otherwise stated, refers to a compound having a molecular weight from abou 1000 and higher. The term "oligomer" refers to a compound having from 2 to about 8 monomer units. The terms oligomer and polymer intend to cover compounds having a single type of repeating monomer unit (homopolymer or oligomer) as well as compounds containing more than one type of monomer unit (copolymers and mixed oligomers). The terms "monomer" or "monomeric" as used herein refer to compounds which are not polymeric or oligomeric as defined above.

The terms "polyacid" and "polybase", as used herein respectively mean compounds having two or more of the "acidic" or "basic" groups in the same molecule, and therefore include the diacid and dibase monomeric molecules within their definitions, respectively. By contrast, the terms polymeric acid and polymeric base, respectively refer to two or more repeating monomeric acidic or basic units joined together.

Optionally" or "optionally" means that the subsequently described event or circumstance may or may not occur, and that the description includes instances where said event or circumstance occurs and instances where it does not. For example, the phrase "optionally substituted" aromatic ring means that the aromatic ring may or may not be substituted and that the description includes both an unsubstituted aromatic ring and an aromatic ring bearing one or more substituents.

SUMMARY OF THE INVENTION

In a first embodiment, the present invention provides a multi-layer opaque and matte ink-jet recording medium, suitable for recording images with dye and pigmented inks, which goes through phase change from opaque to transparent and glossy in at least one printed area to reveal the surface of a substrate and thereby provide light-emitting, reflective, glossy, metallic-looking images or to show holographic images, wherein the recording medium comprises a substrate coated with at least two chemically layers comprising:

(a) a first transparent ink-receptive layer comprising a polymeric binder and a cross-linker and optionally having a plasticizer and pigment particles such as alumina and slilica coated over the substrate, wherein the cross-linker comprises an azetidinium polymer or a salt thereof, and/or a polyfunctional aziridine or a salt thereof, or a polyfunctional oxazoline and metallic salts; and (b) a second ink-receptive layer comprising an opaque or semi-opaque coating composition, wherein the opaque or semi-opaque coating composition is capable of accepting a printed image and thereby becoming semi-transparent or clearly transparent from application of ink-jet printing ink or similar inks, while presenting a light-emitting, reflective, glossy, metallic-looking or holographic image of high clarity and quality, wherein said first layer is located between said second layer and the substrate in said recording medium and the first and second layer are chemically coupled.

A preferred embodiment of the above invention provides such a multi-layer opaque and matte ink jet recording medium, wherein the cross-linker salts may comprise a ionic member selected from the group consisting of ammonium, zirconium, carbonate, boric acid or zinc chloride, and each of the layer may optionally contain one or more binder(s) selected from the group consisting of starch derivatives, cellulosic derivatives, or polypeptides.

Another preferred embodiment of the above invention provides such a multi-layer opaque and matte ink-jet recording medium, wherein the second ink-receptive layer comprises a polyacrylic acid salt, polyethyleneimine, and/or ethoxylated polyethyleneimine, and optionally a starch derivative filler.

In another aspect, the present invention provides a process for producing a clear, light-emitting, highly reflective, glossy, metallic-looking or holographic image comprising contacting the recording medium as described above with a recording liquid, wherein the opaque or semi-opaque coating composition is such that it becomes transparent or semi-opaque upon contact with the recording liquid.

In another embodiment of the invention, the invention provides a continuous or intermittent recording process utilizing a recording medium as described above comprising a substrate having a surface selected from the group consisting of glossy surfaces, reflective surfaces and luminescent surfaces, coated with an opaque coating composition that becomes transparent upon contact with a recording liquid, wherein the recorded medium is produced without sufficient tackiness to cause adhering of multiple sheets of the recording medium during continuous recording.

In a further embodiment of the invention, a process is provided for producing a light-emitting, glossy, reflective, metallic-looking or holographic image comprising the steps of (1) forming a first layer (a) as described above on a substrate above having a surface selected from the group consisting of reflective surfaces, metallic and luminescent surfaces (2) forming a pre-selected image or color scheme on top of the first layer (a), (3) applying an opaque or semi-opaque coating composition second layer (b) on top of the pre-selected image or color scheme, and (4) applying a recording liquid to the pre-printed and coated substrate, wherein the opaque or semi-opaque coating composition becomes semi-opaque or transparent upon contact with the recording medium.

DETAILED DESCRIPTION OF THE INVENTION

In a first embodiment, the present invention provides a multi-layer opaque and matte ink-jet recording medium, suitable for recording images with dye and pigmented inks, which goes through phase change from opaque to transparent and glossy in at least one printed area to reveal the surface of a substrate and thereby provide light-emitting, reflective, glossy, metallic-looking images or to show holographic images, wherein the recording medium comprises a substrate coated with at least two chemically layers comprising:

(a) a first transparent ink-receptive layer comprising a polymeric binder and a cross-linker and optionally having a plasticizer and pigment particles such as alumina and slilica coated over the substrate, wherein the cross-linker comprises an azetidinium polymer or a salt thereof, and/or a polyfunctional aziridine or a salt thereof, or a polyfunctional oxazoline and metallic salts; and (b) a second ink-receptive layer comprising an opaque or semi-opaque coating composition, wherein the opaque or semi-opaque coating composition is capable of accepting a printed image and thereby becoming semi-transparent or clearly transparent from application of ink-jet printing ink or similar inks, while presenting a light-emitting, reflective, glossy, metallic-looking or holographic image of high clarity and quality, wherein said first layer is located between said second layer and the substrate in said recording medium and the first and second layer are chemically coupled.

A preferred embodiment of the above invention provides such a multi-layer opaque and matte ink-jet recording medium, wherein the cross-linker salts may comprise a ionic member selected from the group consisting of ammonium, zirconium, carbonate, boric acid or zinc chloride, and each of the layer may optionally contain one or more binders selected from the group consisting of starch derivatives, cellulosic derivatives, or polypeptides.

Another preferred embodiment of the above invention provides such a multi-layer opaque and matte ink-jet recording medium, wherein the second ink-receptive layer comprises a polyacrylic acid salt, polyethyleneimine, and/or ethoxylated polyethyleneimine, and optionally a starch derivative binder or filler.

In another aspect, the present invention provides a process for producing a clear, light-emitting, highly reflective, glossy, metallic-looking or holographic image comprising contacting the recording medium as described above with a recording liquid, wherein the opaque or semi-opaque coating composition is such that it becomes transparent or semi-opaque upon contact with the recording liquid.

In a preferred aspect the present invention provides an ink-jet recording medium as described above, wherein the cross-linker of the first ink-receptive layer comprises an azetidinium polymer salt comprising monomer units having the structural formula:

(I)

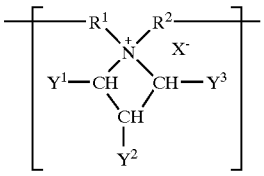

in which $R^1$ and $R^2$ are independently lower alkylene, $X^-$ is an anionic, organic or inorganic counterion, and $Y^1$, $Y^2$ and $Y^3$ are selected from the group consisting of hydrogen, hydroxyl, halo, alkoxy, alkyl, amino, carboxy, acetoxy, cyano and sulfhydryl, and the cross-linker of the first ink-receptive layer further comprises a polyaminoamide epichlorohydrin resin, or a salt thereof.

Preferred azetidinium salts for the polymer in the first layer of the ink-jet recording medium, as described above, are salts wherein the $X^-$ anion of the salt is a halide, and an azetidinium polymer salt is a homopolymer or a copolymer salt. More preferred azetidinium salts for the ink-jet recording medium described are salts, wherein, in the azetidinium polymer salt, $R^1$ and $R^2$ are methylene, $Y^1$ and $Y^3$ are independently hydrogen or lower alkyl, and $Y^2$ is hydrogen or hydroxyl, and $X^-$ is a halide anion. More preferred are such salts wherein $Y^1$ and $Y^3$ are both hydrogen, $Y^2$ is hydroxyl.

Preferred cross-linkers for the ink-jet recording medium first ink-receptive layer as described above are polymers or polymer salts that are soluble in an aqueous solvent or are soluble in a solvent mixture of an aqueous solvent and a polar organic solvent. Preferably, the polar organic solvent is an alcohol.

In one aspect the present invention provides such an ink-jet recording medium, wherein the ink-jet recording medium is capable of accepting a printed image and presenting a metallic-looking image.

In one embodiment of the present invention, the invention provides an ink-jet recording medium having a first ink-jet receptive layer as described and further comprising the polymeric binder as described above, wherein the opaque or semi-opaque coating composition in the second ink-receptive layer of the ink-jet recording medium comprises an ammonium salt of either a monomeric or polymeric polyacid which is obtained by reacting the polyacid with ammonia or a volatile amine, and either a monomeric or polymeric polybase, wherein the polyacid of the polyacid ammonium salt contains two or more polyacid contains two or more carboxylic, sulfonic and/or phosphonic acid groups and the polybase contains two or more primary, secondary or tertiary amine groups.

In one preferred embodiment, the second ink-receptive layer of the ink-jet recording medium described above comprises single or multiple coatings of the opaque or semi-opaque coating composition that collectively provide a multilayer coating of the second ink-receptive layer on top of the first ink-receptive layer and the coated substrate. Optionally, such an ink-jet recording medium may have at least two different opaque coating compositions separately applied to the substrate to produce the multilayer coating of the second ink-receptive layer on top of the first ink-receptive layer and the coated substrate. Preferred are such compositions wherein the cross-linker of (a) in the first ink-receptive layer further comprises a polyfunctional aziridine or a salt thereof.

In a further preferred embodiment, one or more of the first and second ink receptive layers in the ink-jet recording medium described above may contain at least one polymer that is soluble in an aqueous solvent or in a solvent mixture of an aqueous solvent and a polar organic solvent, wherein the polymer is a member selected from the group consisting of (a), (b), (c) or a combination thereof:

(a) 2-hydroxyethylmethacrylate/co-acrylic acid copolymer, 2-hydroxyethyl-methacrylate/methacrylic acid copolymer, 2-hydroxyethylmethacrylate/dimethylaminopropylmethacrylate, 2-hydroxyethyl-methacrylate/dimethyl-aminoethylmethacrylate, and 2-hydroxyethylmethacrylate-vinylpyrrolidone, quaternized polyhydroxyethlymethacrylate-co-dimethylaminopropylmethacrylate, quaternized polyhydroxyethlymethacrylate-co-dimethylaminoethyl methacrylate, (b) vinylpyrrolidone polymers and copolymers that are selected from the group consisting polyvinylpyrrolidone vinylpyrrolidone/dimethylaminoethyl methacrylate copolymer, vinyl caprolactam/vinylpyrrolidone/dimethylaminoethyl methacrylate terpolymer, vinylcaprolactam/vinylpyrroldone/dimethylaminopropyl methacrylamide terpolymer, vinylpyrrolidone/ dimethylaminopropyl methacrylamide copolymer, vinylpyrrolidone/dimethylaminoethyl methacrylate copolymer, and quaternized derivatives thereof, or (c) polyethyloxazoline or a salt thereof.

Any of the ink-jet recording medium described above may contain in one or more of the first and second ink receptive layers at least one member selected from the group consisting of partially or fully hydrolysed polyvinyl alcohol and their derivatives, a HEMA copolymers, vinylpyrrolidone polymers and co-polymers and cationic polyurethane and a mixture of at least two members thereof. Such an ink-jet recording medium may also independently include within each of the first and second layers a plasticizer which is a member selected from the group consisting of phosphates, substituted phthalic anhydrides, glycerols, and polyglycols. A preferred plasticizer is polyethylene glycol or a derivative thereof.

In each of the ink-jet recording medium described above, each of the first and second layers may independently further comprise solvent absorbing particles such as inorganic particles or an inorganic pigment. Additionally, each of the first and second layers may independently further comprise organic particulates selected from the group consisting of starch, polyolefins, poly(methyl methacrylates), polystyrenes, polytetrafluoroethylenes, polyurethanes, and polyvinylpyrrolidone, and each of the first and second layers may independently further comprise additives selected from the group consisting of antifoam agents, surfactants, dyestuffs, optical brighteners, and mixtures thereof.

In each of the ink-jet recording medium described above, each of the first and second layers may independently also further comprise particles of alumina, silica, calcium carbonate and the like, wherein such particles are preferably about 1 to 50 microns in size. Larger particles, smaller particles, or simply differently colored particles may be utilized to give a desired aesthetic character to a particular transparent, opaque or semi-opaque layer.

The ink-jet recording medium of the present invention is preferable obtained from a substrate selected from the group consisting of a paper substrate, a polymeric film substrate, a metallic reflective substrate, or a holographic substrate that is receptive to the first and second layers of the invention.

One preferred ink-jet recording medium describe above is obtained from a substrate which is a paper selected from the group consisting of plain, clay-coated, resin-coated, and latex-saturated papers.

Another preferred ink-jet recording medium described above is wherein the substrate is a polymeric film selected from the group consisting of polyvinyl chloride, polyethylene, polypropylene, polycarbonate, polyimide, polyester, and fluoroplastic films.

One preferred embodiment of the ink-jet recording medium according to the invention as described above is wherein the coated substrate is glossy and opaque, transparent, translucent, matte, metallic, semi-opaque or non-glossy (mat) opaque.

The ink-jet recording medium of the invention may have one or more functional or non-functional coating layers are placed between the substrate and two coating layers (a) and (b).

One embodiment of the invention is a method for providing a water-resistant image on the ink-jet recording medium of the invention as described above, comprising applying an ink wherein the ink composition comprises an aqueous or organic solvent type dye that is capable of reacting with an opaque or semi-opaque ink receptive layer and changing it into a transparent or semi-transparent layer.

In one embodiment of this method according to the invention, the ink composition is a predominantly aqueous based ink or is an ink having a mixed solvent of at least one aqueous solvent and at least one aqueous miscible organic solvent.

Another embodiment of the invention provides a printed paper product prepared by a method comprising applying an ink composition to the ink-jet recording of the invention as described above, comprising applying an ink wherein the ink composition comprises an aqueous or organic solvent type dye that is capable of reacting with an opaque or semi-opaque ink receptive layer and changing it into a transparent or semi-transparent layer. Preferably the ink composition comprises a dye having ionizable and/or nucleophilic groups capable of reacting with a dye-fixing compound, and wherein the dye composition is a predominantly aqueous based ink or is an ink having a mixed solvent of at least one aqueous solvent and at least one aqueous miscible organic solvent.

The invention also provides in one embodiment a printed substrate product having one surface of the product comprising an adhesive backing that is optionally removable, wherein the printed substrate is prepared by a method comprising applying an ink composition to the ink-jet recording medium of the invention as described above, wherein the ink composition comprises an aqueous or organic solvent type dye that is capable of reacting with an opaque or semi-opaque ink receptive layer and changing it into a transparent or semi-transparent layer. Preferably, the ink composition utilized comprises a dye having ionizable and/or nucleophilic groups capable of reacting with a dye-fixing compound, wherein the dye composition is a predominantly an aqueous based ink or is an ink having a mixed solvent of at least one aqueous solvent and at least one aqueous miscible organic solvent.

In one preferred embodiment of the invention, the ink-receptive layer (b) comprises an ammonium salt of a monomeric polyacid selected from the group consisting of oxalic acid, maleic acid, succinic acid, methylsuccinic acid, malonic acid, adipic acid, glutaric acid, fumaric acid, dihydroxyfumaric acid, malic acid, mesaconic acid, itaconic acid, phthalic acid, isophthalic acid, terephthalic acid, 1,2-, 1,3- and 1,4-cyclohexane dicarboxylic acids, 1,2,3-cyclohexane tricarboxylic acid, 1,2,4-cyclohexane tricarboxylic acid, 1,3,5-cyclohexane tricarboxylic acid, 1,2- and 1,3-cyclopentane dicarboxylic acids, citric acid, tartaric acid, dihydroxyterephthalic acid, 1,2,3-, 1,2,4- and 1,2,5-benzene tricarboxylic acids, tricarballylic acid, 1,2,4,5-benzene tetracarboxylic acid, norbornene tetracarboxylic acid, 3',4,4'-benzophenone tetracarboxylic acid, 1,2,3,4,5,6-benzene hexacarboxylic acid, aspartic acid, glutamic acid, and combinations thereof, and comprises a monomeric polybase selected from the group consisting of ethylenediamine, 1,2-propane diamine, 1,3-propanediamine, 1,2,3-triaminopropane, cis-1,2-cyclohexanediamine, trans-1,2-cyclohexanediamine, 1,3-bis(aminomethyl)cyclohexane, o-, m- and p-phenylenediamine, tetramethyl o-, m- and p-phenylenediamine, hexamethylene-iamine, hexamethylenetetraamine, diethylenetriamine, tetraethylenepentamine, pentaethylene-examine, pentamethyl diethylenetriamine, tris(2-aminoethyl)amine, 1,1,4,7,10,10-hexamethyl triethylenetetramine, tetramethyl-p-phenylenediamine, tetramethylethylenediamine, triethylenetetraamine, 4,4'-bipyridyl, and combinations thereof.

In a more preferred embodiment, the ink-jet recording medium comprises a monomeric polybase selected from the group consisting of ethylenediamine, 1,2-propane diamine, 1,3-propanediamine, 1,2,3-triaminopropane, cis-1,2-cyclohexanediamine, trans-1,2-cyclohexanediamine, 1,3-bis (aminomethyl)cyclohexane, o-, m- and p-phenylenediamine, tetramethyl o-, m- and p-phenylenediamine, hexamethylene-iamine, hexamethylenetetraamine, diethylenetriamine, tetraethylenepentamine, pentaethylene-examine, pentamethyl diethylenetriamine, tris(2-aminoethyl)amine, 1,1,4,7,10,10-hexamethyl triethylenetetramine, tetramethyl-p-phenylenediamine, tetramethylethylenediamine, triethylenetetraamine, 4,4'-bipyridyl, and combinations thereof.

In another embodiment of the invention, the ink-jet recording medium as described above may comprise an ammonium salt of a polymeric polyacid and a polybase that is polymeric. Preferably, the polymeric polyacid of the ammonium salt is a carboxylic acid-containing polymer and the polymeric polybase comprises a nitrogenous polymer. More preferably, the polymeric polyacid of the ammonium salt is a member selected from the group consisting of poly(acrylic acid), poly(acrylonitrile-acrylic acid), poly (styrene-acrylic acid), poly(butadiene-acrylonitrile acrylic acid), poly(butylacrylate-acrylic acid), poly(ethyl acrylate-acrylic acid), poly(ethylene-propylene-acrylic acid), poly (propylene-acrylic acid), alginic acid, phytic acid, and combinations thereof, and the polymeric polybase is selected from the group consisting of polyethyleneimine, polyvinylpyridine, polyallylamine (including N-alkylated and N,N-dialkylated polyallylamines), polyvinylaziridine, polyimidazole, polylysine, chitosan, poly(amino and alkylated amino)ethylenes, ethoxylated polyethyleneimine, propoxylated polyethyleneimine, and combinations thereof.

In another aspect the invention provides such an ink-jet recording medium wherein the poly acid of the ammonium salt is monomeric and is a member selected from the group consisting of oxalic acid, maleic acid, succinic acid, methylsuccinic acid, malonic acid, adipic acid, glutaric acid, fumaric acid, dihydroxyfumaric acid, malic acid, mesaconic acid, itaconic acid, phthalic acid, isophthalic acid, terephthalic acid, 1,2-, 1,3- and 1,4-cyclohexane dicarboxylic acids, 1,2,3-cyclohexane tricarboxylic acid, 1,2,4-cyclohexane tricarboxylic acid, 1,3,5-cyclohexane tricarboxylic acid, 1,2- and 1,3-cyclopentane dicarboxylic acids, citric acid, tartaric acid, dihydroxyterephthalic acid, 1,2,3-1,2,4- and 1,2,5-benzene tricarboxylic acids, tricarballylic acid, 1,2,4,5-benzene tetracarboxylic acid, norbomene tetracarboxylic acid, 3,3',4,4'-benzophenone tetracarboxylic acid, 1,2,3,4,5,6-benzene hexacarboxyic acid, aspartic acid, glutamic acid, and combinations thereof, and wherein the polybase is a polymeric polybase member selected from the group consisting of polyethyleneimine, polyvinylpyridine, polyallylamine (including N-alkylated and N,N-dialkylated polyalklylamines), polyvinylaziridine, polyimidazole, polylysine, chitosan, poly(amino and alkylated amino) ethylenes, ethoxylated polyethyleneimine, propoxylated polyethyleneimine, and combinations thereof.

In one embodiment of the invention the second ink-receptive layer of the inkjet recording medium comprises an ammonium salt of a polyacid which is a carboxylic acid-containing polymer selected from the group consisting of poly(acrylic acid), poly(acrylonitrile-acrylic acid), poly (styrene-acrylic acid), poly(butadiene-acrylonitrile acrylic acid), poly(butylacrylate-acrylic acid), poly(ethyl acrylate-acrylic acid), poly(ethylene-propylene-acrylic acid), poly (propylene-acrylic acid), alginic acid, phytic acid, and combinations thereof, and the polybase is a monomeric polybase member selected from the group consisting of ethylenediamine, 1,2-propane diamine, 1,3-propanediamine, 1,2,3-triaminopropane, cis-1,2-cyclohexanediamine, trans-1,2-cyclohexanediamine, 1,3-bis (aminomethyl)cyclohexane, o-, m- and p-phenylenediamine, tetramethyl o-, m- and p-phenylenediamine, hexamethylenediamine, hexamethylenetetraamine, diethylenetriamine, tetraethylenepentamine, pentaethylenehexamine, pentamethyl diethylenetriamine, tris(2-aminoethyl)amine, 1,1,4,7,10,10-hexamethyl triethylenetetramine, tetramethyl-p-phenylenediamine, tetramethylethylenediamine, triethylenetetraamine, 4,4-bipyridyl, and combinations thereof.

In one embodiment of the invention, the ink-jet recording medium contains an opaque or semi-opaque layer obtained from applying an aqueous coating composition that further includes a film-forming binder and a colorant or dyestuff. Preferably, the colorant or dyestuff contains at least one pigment selected from the group consisting of silica, titanium dioxide, calcium silicate and calcium carbonate. In a preferred aspect, the colorant contains an ink-jet recording medium compatible dye.

In a preferred embodiment of the invention, the opaque or semi-opaque coating agent in the second ink-receptive layer of the ink-jet recording represents approximately 5 wt. % to approximately 95 wt. % of the second ink-receptive layer, based upon total solids weight of the composition after drying. In such a preferred embodiment of the ink-jet recording medium, a film-forming binder represents approximately 1 wt. % to approximately 90 wt. % of the second ink-receptive layer, based upon total solids weight of the composition after drying. More preferably, the film-forming binder represents approximately 1 wt. % to approximately 50 wt. % of the second ink-receptive layer, based upon total solids weight of the composition after drying. Even more preferred is wherein a film-forming binder represents approximately 1 wt. % to approximately 15 wt. % of the second ink-receptive layer, based upon total solids weight of the composition after drying.

Preferably, in such ink-jet recording medium, the opaque or semi-opaque coating composition contained in the of the second ink-receptive layer further includes an optical brightener in approximately 0.01 wt. % to approximately 20 wt. % of the opaque or semi-opaque coating composition, and may further includes a crosslinking agent selected from the group consisting of ammonium zirconyl carbonate, zirconium acetate, and preferably, the surface of the substrate is reflective. In a further preferred embodiment, auch a reflective surface may have a preferably have a metallic appearance.

In a preferred embodiment, the metallic appearance ink-jet recording medium described immediately above is obtained from a paper/foil laminate substrate or from a metallized film.

In a preferred embodiment of the invention, the reflective surface of the ink-jet recording medium is holographic.

In a preferred embodiment of the ink-jet recording medium of the invention, the pH of each the coating compositions to provide the transparent first ink-receptive layer and the second opaque layer is a pH between 3 and 12. Further preferred is such an ink-jet recording medium wherein the first transparent layer is coated upon a substrate at a dry coat weight of 4 to 30 grams per square meter. Also, preferred is such an ink-jet recording medium wherein the second opaque layer is coated upon a substrate at a dry coat weight of 2 to 18 grams per square meter.

The invention also provides a process of recording an image on the holographic ink-jet recording medium, comprising the step of using a writing instrument. Preferably, the writing instrument is an ink-jet printer or ink-jet printing press.

Acceptable Substrates for Use in the Invention

A preferred ink-jet recording medium of the invention is wherein the substrate is a paper or polymeric film. One preferred substrate is a paper selected from the group consisting of plain, clay-coated, resin-coated, and latex-saturated papers. Another preferred substrate is a polymeric film selected from the group consisting of polyvinyl chloride, polyethylene, polypropylene, polycarbonate, polyimide, polyester, and fluoroplastic films.

In one preferred embodiment, the inkjet recording medium comprises a coated substrate that is glossy and opaque, transparent, translucent, matte, or non-glossy opaque.

The inkjet recording medium of the present invention may comprise a substrate wherein one or more functional or non-functional coating layers are placed between the paper substrate and two coating layers (a) and (b).

In one preferred embodiment of the invention, a large number of widely varying types of substrates with at least one light-emitting reflective, glossy, metallic, or luminescent surface can be utilized. Such substrates may be comprised of a material that inherently provides a light-emitting, reflective, glossy, metallic, or luminescent surface, or may be comprised of a substrate that does not have such characteristics if it can be coated or treated with a light-emitting, reflective, glossy, metallic, or luminescent material to provide the desired surface. Such substrates may be flexible or rigid, porous or nonporous, cellulosic or non-cellulosic.

Non-limiting examples of substrates suitable for use with the present invention include paper, textiles, polymeric substrates, inorganic substrates, metallic sheets, metallized polymer sheets, laminates, foil laminated polymer sheets, and the like. Specific suitable substrates examples are: polymeric films, sheets, coatings, and solid blocks, comprised of, for example, polyesters (including "MYLAR-.RTM." flexible film), vinyl polymers, polysulfones, polyurethanes, polyacrylates, polyimides, or the like; metallic films, sheets, coatings, foils and solid blocks, comprised of, for example, aluminum, brass, copper, or the like; inorganic substrates in the form of films, sheets, coatings, objects, and solid blocks, comprised, of, for example, glass, metal oxides, silicon-containing ceramics, and the like; textiles having a reflective or luminescent surface; and laminates such as a paper/polymeric film, polymeric film/metal foil laminate, or paper/metal foil laminate. The nature of a substrate is not critical, but a preferred class of substrates are substrates having at least one light emitting, reflective, glossy, metallic, or luminescent surface that can be used in the invention to produce a glossy, reflective, light emitting, luminescent or metallic-looking image when contacted with a recording liquid.

If a substrate that is not itself, light-emitting, reflective, glossy, metallic, or luminescent is used in the invention it may optionally be treated to provide a light-emitting, reflective, glossy, metallic, or luminescent surface. For example, a layer of a metallic foil or reflective polymeric film can be laminated to the substrate, or the substrate surface may be coated or treated with reflective or luminescent materials, for example, luminescent dyes selected from the dye families of fluorescein dyes, rhodamine dyes, pyrene dyes and porphyrin dyes.

In one embodiment of the invention, a preferred substrate comprises a paper/foil laminate or a polymer film that has been metallized by sputtering or by some other thin-layer metallizing process. The paper layer of the laminate may be formed from any convenient type of printing paper stock of desired weight, and may be in the form of a flat or sheet structure of variable dimensions. The term "paper", as used in this context, is meant to encompass printing paper (e.g., inkjet printing or conventional printing paper such as gravure, litho, etc.), writing paper, drawing paper, and the like, as well as board materials such as cardboard, poster board, Bristol board, and the like. Many such paper compositions are well known and various types of additives which can be incorporated into paper for different purposes are also well known and widely described; see for instance, Blair (ed.), The Lithographers Manual, (7 th Edn.: 1983), Chapter 13, Sections 8 and 9.

Methods for preparing a paper/metal foil laminate are well-known, and well-described in the art. Also, commercial paper/foil laminates are available in a range of thicknesses and weights, such that foil papers with any desired degree of flexibility or stiffness can be selected. Those skilled in the art will be readily able to select the appropriate type of paper, foil or paper/foil laminate for use with the desired type and weight of final product to be produced.

In one embodiment the present invention provides a method for providing a water-resistant image on the ink-jet recording medium of the invention as described above, comprising applying an ink composition to the recording medium, wherein the ink composition comprises a dye having ionizable and/or nucleophilic groups capable of reacting with a dye-fixing compound. A preferred such method is wherein the dye composition is a predominantly aqueous based ink or is an ink having a mixed solvent of at least one aqueous solvent and at least one aqueous miscible organic solvent.

Suitable reflective or glossy textiles, or textiles that have been treated with a luminescent material, are also commercially available. Those skilled in the art will be readily able to select the appropriate type of textile that can be used with the desired type and weight of final product to be produced.

Forming Layers (a) and (b) on The Recording Medium

The compositions corresponding to each of the two layers (a) and (b) (transparent or semi-transparent first ink-receptive layer, and second opaque or semi-opaque ink-receptive layer, respectively) may be applied to an acceptable substrate in any conventional manner, for example, by using a Meyer rod, slot die, roller, knife, dipping, painting, spraying, etc. Generally, coating is accomplished by rod coating, dip coating, reverse roll coating, extrusion coating, or the like. If the substrate is a paper or thin polymeric film and the coating composition is applied on-machine, in order to achieve acceptable manufacture speeds of about 100 to 2000 feet per minute, preferably 100–1000 feet per minute, it is recommended that the weight of the substrate, e.g., sized paper, be greater than about 30 grams per square meter.

In one embodiment, the opaque coating compositions for the second ink-receptive layer are composed of at least one opaque coating agent that comprises a mixture of an ammonium salt of a polyacid in admixture with a polybase, as described above. Such opaque coating compositions can be readily prepared from commercially available starting materials and/or reagents, are compatible with additional binders or additives, can be used with a variety of substrates, are compatible with a variety of printing methods, including conventional and digital printing methods (particularly ink-jet printing, including drop-on-demand printing and continuous printing), and can also be used with existing commercial manufacturing methods and equipment, including, for example, paper production processes and equipment.

The opaque coating agent for the second ink-receptive layer coating compositon typically represents about 5% to 95%, preferably about 10% to 95%, of the coating composition, based upon total solids weight of the composition after drying.

The ammonium salt of the polyacid and polybase, which are each present in the second ink-receptive layer, may be present either as monomeric or polymeric components as described above. For example, they may be composed of any suitable combination of: 1) an ammonium salt of a monomeric polyacid and a monomeric polybase; 2) an ammonium salt of a polymeric polyacid and a polymeric polybase; 3) an ammonium salt of a polymeric polyacid and a monomeric polybase; and/or 4) an ammonium salt of a monomeric polyacid and a polymeric polybase that are desired, as described above in greater detail. The composition utilized in the second ink-receptive layer comprised of more than one different type of these ammonium salt of a polyacid agents or polybase agents, and compositions comprised of, for example, an ammonium salt of a monomeric polyacid, a monomeric polybase, and a polymeric polybase or an ammonium salt of a monomeric poly acid, an ammonium salt of a polymeric polyacid, and a monomeric and/or polymeric polybase and the like are also possible. The selection of these combinations for use as the second ink-receptive layer coating agent in the present coating compositions may be varied according to a variety of factors such as the nature of the substrate to be treated, the colorant to be used in printing on the treated substrate, etc. The relative ratios of the polyacid and polybase within the mixture will also vary according to such factors, but typically the ratio of base to acid is in the range of approximately 0.5:1 to 10:1, more typically in the range of approximately 1:1 to 3:1.

In general, the pH of the coating composition having an ammonium salt of polyacid/polybase opaque coating agent is generally in the range of about 7–12, preferably at least about 7.5–10. The pH can be maintained by adding pH stabilizers such as appropriate bases such ammonia, primary, secondary, and tertiary alkyl amines, ethanolamines, diamine, and the like. Such ammonium salts of polyacids and polybases that are acceptable for the second ink-receptive layer as described in the present invention are generally well-known and available in the art. They are used in the proportions set forth above in the more detailed description of the second ink-receptive layer.

Additional Film Forming Binders

In addition to film-forming binders described above that may be used as additives for either of the two ink-receptive layers (a) and (b), other such substances may be utilized in the coating compositions or in intermediate layers to provide improved strength for a substrate upon application of such binders. "Film-forming binders" used in connection with the compositions of the invention include any film-forming binders that are compatible with either of the two ink-receptive layer compositions. Examples of other acceptable film-forming binders are: polysaccharides and derivatives thereof, e.g., starches (such as Filmkote 54, 51-4921 from National Starch & Chemical Company, Finderne Avenue, Bridgewater, N.J. 08807), cellulosic polymers, dextran and the like; polypeptides (e.g., collagen and gelatin); and synthetic polymers, particularly synthetic vinyl polymers such as poly(vinyl alcohol), poly(vinyl phosphate), poly(vinyl pyrrolidone), vinyl-pyrrolidone-vinyl acetate copolymers, vinyl acetate-acrylic acid copolymers, vinyl alcohol-vinyl acetate copolymers, vinyl pyrrolidone-styrene copolymers, and poly(vinyl amine), synthetic acrylate polymers and copolymers such as poly(acrylic acid-co-methacrylate), poly (vinyl-co-acrylate), poly(vinylpyrrolidone-co-dimethylaminopropyl-methacrylamide), and the like, and water-soluble or water-dispersible polyesters such as sulfopolyesters (e.g., as available from Eastek).

A. Ancillary Polysaccharide Binders

Starches represent one category of suitable film-forming binders. Suitable starches may be any of a variety of natural, converted, and synthetically modified starches. Examples of such starches include: starch (e.g., SLS-280 (St. Lawrence Starch)), cationic starches (e.g., Cato-72 (National Starch), hydroxyalkylstarch, wherein the alkyl has at least one carbon atom and wherein the number of carbon atoms is such that the material is water soluble, preferably from about 1 to about 10 carbon atoms, such as methyl, ethyl, propyl, butyl, or the like (e.g., hydroxypropyl starch #02382 (PolySciences, Inc.), hydroxyethyl starch #06733 (PolySciences, Inc.), Penford Gum 270 and 280 (Penford), and Film-Kote (National Starch)), starch blends (see, e.g., U.S. Pat. No. 4,872,951, describing a blend of cationic starch and starch treated with an alkyl or alkenyl succinic anhydride (ASA), preferably 1-octenyl succinic anhydride (OSA)), and the like. Such film-forming binder can also be synthetically produced polysaccharides, such as a cationic polysaccharide esterified by a dicarboxylic acid anhydride (see, e.g., U.S. Pat. No. 5,647,898). Additional saccharide binders include cellulosic materials such as alkyl celluloses, aryl celluloses, hydroxy alkyl celluloses, alkyl hydroxy alkyl celluloses, hydroxy alkyl celluloses, dihydroxyalkyl cellulose, dihydroxyalkyl cellulose, hydroxy alkyl hydroxy alkyl cellulose, halodeoxycellulose, amino deoxycellulose, dialkylammonium halide hydroxy alkyl cellulose, hydroxyalkyl trialkyl ammonium halide hydroxyalkyl cellulose, dialkyl amino alkyl cellulose, carboxy alkyl cellulose salts, cellulose sulfate salts, carboxyalkylhydroxyalkyl cellulose and the like). Still additional film-forming binders of this type include dextran (e.g., dialkyl aminoalkyl dextran, amino dextran, and the like), carrageenan, Karaya gum, xanthan, guar and guar derivatives, (e.g., carboxyalkyl hydroxyalkyl guar, cationic guar, and the like), and gelatin.

B. Ancillary Resin Binders

Additional film-forming binders are resins (e.g., such as formaldehyde resins such as melamine-formaldehyde resin, urea-formaldehyde resin, alkylated urea-formaldehyde resin, and the like), ionic polymers (e.g., poly(2-acrylamide-2-methyl propane sulfonic acid, poly(N,N-dimethyl-3,5-dimethylene piperidinium chloride, poly(methylene-guanidine), and the like), maleic anhydride and maleic acid-containing polymers (e.g., styrene-maleic anhydride copolymers, vinyl alkyl ether-maleic anhydride copolymers, alkylene-maleic anhydride copolymers, butadiene-maleic acid copolymers, vinylalkylether-maleic acid copolymers, alkyl vinyl ether-maleic acid esters, and the like), acrylamide-containing polymers (e.g., poly(acrylamide), acrylamide-acrylic acid copolymers, poly(N,N-dimethyl acrylamide), and the like), poly(alkylene imine)-containing polymers (e.g., poly(ethylene imine), poly(ethylene imine) epichlorohydrin, alkoxylated poly(ethylene imine), and the like), polyoxyalkylene polymers (e.g., poly(oxymethylene), poly(oxyethylene), poly(ethylene oxide), ethylene oxide/propylene oxide copolymers, ethylene oxide/2-hydroxyethyl methacrylate/ethylene oxide and ethylene oxide/hydroxypropyl methacrylate/ethyleneoxide triblock copolymers, ethylene oxide-4-vinyl pyridine/ethylene oxide triblock copolymers, ethylene oxide-isoprene/ethylene oxide triblock copolymers, epichlorohydrin-ethylene oxide copolymer, and the like), etc.

Any of the above exemplary film-forming binders can be used in any effective relative amounts, although typically such film-forming binder, if present, collectively with other film forming binders that may be present represent approximately 1 wt. % to 50 wt. %, preferably 1 wt. % to 25 wt. %, most preferably 1 wt. % to 15 wt. % of the second ink-receptive layer composition, after drying on a substrate, the amount of binder utilized in the first ink-receptive layer has been described above, earlier. Starches and latexes are of particular interest as ancillary binders for either of the two ink-receptive layers because they are readily available and are readily applicable to a variety of substrates.

Additional Components for the Ink-Receptive Layers

Additional components may be present in each of the coating composition utilized for the two ink receptive layers. Non-limiting examples of such additional components are inorganic fillers, anti-curl agents, surfactants, plasticizers, humectants, UV absorbers, optical brighteners, light fastness enhancers, polymeric dispersants, dye mordants and leveling agents. Such additional components and their use are commonly known in the art. Preferred additives are optical brighteners, which generally represents approximately 0.0 wt. % to 2.0 wt. % of the coating composition after drying on a substrate. Illustrative examples of such additives are provided in U.S. Pat. Nos. 5,279,885 and 5,537,137. The coating compositions may also include one or more crosslinking agents selected from the group consisting of zirconium acetate, ammonium zirconium carbonate, or the like, for intramolecular and/or intermolecular crosslinking of coating agents, and/or a chelating agent such as boric acid. Colorants e.g., pigments, dyes, or other colorants, may also be present in the opaque coating composition.

Preparation of the Coating Compositions

While the coating compositions can each be prepared in an organic solvent, it is preferably provided in an aqueous liquid vehicle wherein small amounts of a water-soluble organic solvent may be present. The aqueous liquid vehicle will generally be water, although other inorganic compounds which are either water-soluble or water miscible may be included as well. It may on occasion be necessary, or desired, to add a solubilizing compound during preparation of the coating composition so that the components dissolve in the aqueous liquid vehicle, e.g., an inorganic base such as ammonia and/or an organic amine. Suitable organic amines include lower alkyl-substituted amines such as methylamine, dimethylamine, ethylamine, and trimethylamine, as well as ethanolamine, diethanolamine, triethanolamine, and substituted ethanolamines, typically lower alkyl-substituted ethanolamines such as N-methyl and N,N-dimethyl ethanolamines, and morpholine. Such compounds are also useful for bringing the pH into the desired range for basic formulations as discussed above, and, if present, will generally represent not more than about 20 wt. % of the composition, and in most cases will represent not more than about 10 wt. % of the composition.

Image Formation

The ink-jet recording medium, as described above, is contacted with an ink or other solution to render the coating transparent. In one preferred embodiment, an image forming step is employed that involves applying an aqueous or solvent based ink to obtain desired image or background colors and thereby form a mat, light-emitting, reflective, glossy, luminescent, or metallic-looking image. An image forming step may employ any of a variety of well-known machine or process printing techniques, such as inkjet printing, laserjet printing, flexographic printing, gravure printing and the like. In another embodiment, the image forming step may employ a writing instrument such as a pen, marker, gel pen, rollerball pen, ballpoint pen, and the like. In general, the image forming process involves applying a recording liquid in a desired image pattern to the ink-jet recording medium or other coated substrate of the invention.

Many inkjet printing processes may be utilized to form an image on the ink-jet recording medium of the invention that are well known in the art, e.g., U.S. Pat. Nos. 4,601,777; 4,251,824; 4,410,899; 4,412,224; and 4,532,530. Also, thermal ink transfer printers maybe utilized, which apply an image to a substrate by a dye sublimation process, to also form a light-emitting, reflective, luminescent, or metallic-looking images. Hot melt type inkjet printers, such as Tektronix ink jet printers that use inks formed of low melting solids are also suitable. Light-emitting, reflective or metallic-looking images can also be produced using a wide variety of other printing and imaging processes, such as offset printing, printing with pen plotters, drawing, handwriting, painting with ink pens, brush stenciling, spray painting, and the like.

In one embodiment of the invention, inks are used in the formation of the image on the ink-jet recording medium or other substrates of the invention. Such an ink may be any suitable ink containing a colorant, e.g., a pigment, dye, or stain, having one or more reactive groups suitable for reacting, either covalently or ionically, with a colorant-reactive component of the opaque coating agent present on the treated substrate. Additionally, aqueous and solvent-based, dye sublimation, or hot melt inks can be utilized with the ink-jet recording medium of the invention, or other coated substrates. The particular selection of the specific ink and colorant can vary with the colorant-reactive component of the image-enhancing agent. Thus, preferred colorants for use in forming an image on a substrate treated with the present image-enhancing compositions are those containing one or more ionizable, nucleophilic or otherwise reactive moieties.

Particularly preferred colorants contained in the inks useful with the invention are thus dyes containing acidic groups (e.g., carboxylate, phosphonate, sulfonate or thiosulfonate moieties), basic groups (e.g., unsubstituted amines or amines substituted with 1 or 2 alkyl, typically lower alkyl, groups), and/or nucleophilic or otherwise reactive moieties (e.g., hydroxyl, sulfhydryl, cyano or halo).

Selection of a particular ink for recording an image upon the substrates or recording medium of the invention depends upon the requirements of a specific application, such as desired surface tension, viscosity, drying time, and the like. If an aqueous ink is selected, the aqueous liquid vehicle of inks suitable for use in the invention will generally be water, although other non-organic compounds which are either water-soluble or water miscible may be included as well. A water soluble organic vehicle such as an alcohol may also be used in such inks. The colorant may be dissolved, dispersed or suspended in the aqueous liquid (or other polar vehicle), and is present in an amount effective to provide the dried ink with the desired color and color intensity.

As mentioned above, a can also be contained in a carrier medium composed of ink and a water-soluble organic solvent. For applications utilizing such a carrier medium, representative solvents include polyols such as polyethylene alcohol, diethylene glycol, propylene glycol, and the like. Additional solvents are simple alcohols such as ethanol, isopropanol and benzyl alcohol, and glycol ethers, e.g., ethylene glycol monomethyl ether, diethylene glycol monoethyl ether. Representative examples of water-soluble organic solvents are described in U.S. Pat. Nos. 5,085,698 and 5,441,561.

Non-limiting examples of suitable water soluble organic solvents for inks that may be utilized to record an image on the recording media according to the invention, are not limited to, $C_{1-5}$-alkanols, e.g. methanol, ethanol, n-propanol, isopropanol, n-butanol, sec-butanol, tert-butanol and isobutanol; amides, e.g., dimethylformamide and dimethylacetamide; ketones and ketone alcohols, e.g., acetone and diacetone alcohol; $C_{2-4}$-ethers, e.g. tetrahydrofuran and dioxane; alkylene glycols or thioglycols containing a $C_2$–$C_6$ alkylene group, e.g., ethylene glycol, propylene glycol, butylene glycol, pentylene glycol and hexylene glycol; poly(alkylene-glycol)s and poly(alkylene-thioglycol)s, e.g., diethylene glycol, thiodiglycol, polyethylene glycol and polypropylene glycol; polyols, e.g., glycerol and 1,2,6-hexanetriol; lower alkyl glycol and polyglycol ethers, e.g., 2-methoxyethanol, 2-(2-methoxyethoxy)ethanol, 2-(2-ethoxyethoxy)-thanol, 2-(2-butoxyethoxy)ethanol, 3-butoxypropan-1-ol, -[2-(2-methoxyethoxy)-eth-oxy]ethanol, 2-[2-(2-ethoxyethoxy) ethoxy]-ethanol; cyclic esters and cyclic amides, e.g., optionally substituted pyrollidones; sulpholane; and mixtures containing two or more of the aforementioned water soluble organic solvents. Water insoluble organic solvents may also be used. Suitable water insoluble organic solvents include, but are not limited to, aromatic hydrocarbons, e.g., toluene, xylene, naphthalene, tetrahydronaphthalene and methyl naphthalene; chlorinated aromatic hydrocarbons, e.g., chlorobenzene, fluorobenzene, chloronaphthalene and bromonaphthalene; esters, e.g., butyl acetate, ethyl acetate, methyl benzoate, ethyl benzoate, benzyl benzoate, butyl benzoate, phenylethyl acetate, butyl lactate, benzyl lactate, diethyleneglycol dipropionate, dimethyl phthalate, diethyl phthalate, dibutyl phthalate, di(2-ethylhexyl)phthalate; alcohols having six or more carbon atoms, e.g. hexanol, octanol, benzyl alcohol, phenyl ethanol, phenoxy ethanol, phenoxy propanol and phenoxy butanol; ethers having at least 5 carbon atoms, preferably C.sub.5–14 ethers, e.g. anisole and phenetole; nitrocellulose, cellulose ether, cellulose acetate; low odor petroleum distillates; turpentine; white spirits; naphtha; isopropylbiphenyl; terpene; vegetable oil; mineral oil; essential oil; and natural oil; and mixtures of any two or more thereof.

Specific non-limiting examples of suitable colorants are: Dispersol Blue Grains (Zeneca, Inc.), Duasyn Acid Blue (Hoechst Celanese), Duasyn Direct Turquoise Blue (Hoechst Celanese), Phthalocyanine blue (C.I. 74160), Diane blue (C.I. 21180), Pro-jet Cyan 1 (Zeneca, Inc.), Pro-jet Fast Cyan 2 (Zeneca, Inc.), Milori blue (an inorganic pigment equivalent to ultramarine) as cyan colorants; Dispersol Red D-B Grains (Zeneca, Inc.), Brilliant carmine 6B (C.I. 15850), Pro-jet magenta 1 (Zeneca, Inc.), Pro-jet Fast magenta 2 (Zeneca, Inc.), Brilliant Red F3B-SF (Hoechst Celanese), Red 3B-SF (Hoechst Celanese), Acid Rhodamine (Hoechst Celanese), Quinacridone magenta (C.I. Pigment Red 122) and Thioindigo magenta (C.I. 73310) as magenta colorants; Dispersol Yellow D-7G 200 Grains (Zeneca, Inc.), Brilliant yellow (Hoechst Celanese), Pro-jet yellow 1 (Zeneca, Inc.), Pro-jet Fast Yellow 2 (Zeneca, Inc.), benzidine yellow (C.I. 21090 and C.I. 21100) and Hansa Yellow (C.I. 11680) as yellow colorants; organic dyes; and black materials such as carbon black, charcoal and other forms of finely divided carbon, iron oxide, zinc oxide, titanium dioxide, and the like. Specific and preferred black colorants include Acid Black 48 (Aldrich), Direct Black 58756 A (Crompton & Knowles), BPI Molecular Catalytic Gray (Brain Power), Fasday Cool Gray (Hunter Delator), Dispersol Navy XF Grains (Zeneca, Inc.), Dispersol Black CR-N Grains (Zeneca, Inc.), Dispersol Black XF Grains (Zeneca, Inc.), Disperse Black (BASF), Color Black FWI 8 (Degussa), Color Black FW200 (Degussa), Hostafine Black TS (Hoechst Celanese), Hostafine Black T (Hoechst Celanese), Duasyn Direct Black (Hoechst Celanese), Pro-jet Black 1 (Zeneca, Inc.) and Pro-jet Fast Black 2 (Zeneca, Inc.). Other suitable colorants are disclosed in U.S. Pat. Nos. 4,761,180, 4,836,851, 4,994,110 and 5,098,474.

In an additional aspect of the invention a light-emitting, reflective, luminescent or metallic-looking image can be produced by having the image or color scheme printed on the substrated prior to its being coating with the two ink-receptive layers. In such a case, the light-emitting, reflective, luminescent or metallic-looking image can be generated by contacting the coated substrate with an aqueous solution that may optionally contain a dye or colorant, as discussed above.

All patents, patent applications, journal articles and other references mentioned herein are incorporated by reference in their entireties.

Experimental

The following examples are put forth so as to provide those of ordinary skill in the art with a complete disclosure and description of how to prepare and use the compounds disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in degree C. and pressure is at or near atmospheric.

In the examples below, unless otherwise stated, the abbreviations and terms employed have their generally accepted meanings. Abbreviations and tradenames are as follows (note that suppliers of each material are indicated as well):

Joncryl 62=Joncryl 62.RTM., arcrylic polymer (SC Johnson);

Epomine 1050=Epomine 1050.RTM., polyethylene imine (Nippon Shokubai, Co Ltd.);

ISP 937=ISP 937.RTM., polyvinylpyrrolidone-dimethylaminomethacrylat-e (ISP);

PVA 523S=PVA 523S.RTM., polyvinyl alcohol, binder (Airvol 523S.RTM., Air Product);

Acusol 445=Acusol 445.RTM., acrylate copolymer (Rohm & Haas Co.)

Alcosperse 409=Alcosperse 409.RTM., polyacrylic acid (Alco Chemical);

Surfynol SE-F=Surfynol SE-F.RTM., surfacant (Air Product);

Lupasol SKA=Lupasol SKA.RTM., ethoxylated polyethylenimine (BASF);

Rhophex AR-74=Rhophex AR-74.RTM., acrylic polymer (Rohm & Haas Co.);

Silica=Aerosil MOX 170.RTM., fumed silica (Degussa).

EXAMPLES OF MULTILAYER LAYER REFLECTIVE MEDIA

Fast Drying Transparent First Layer

Example-1

| | |
|---|---|
| Hydroxyethyl mathacrylate copolymer | 92 parts |
| Polyamino amid-epichlorohydrine adduct(Hercules) | 6 parts |
| Polyethylene oxide siloxane and surfactants(OSi) | 2 parts |

Example-2

| | |
|---|---|
| Hydroxyethyl mathacrylate copolymer | 60 parts |
| Polyvinyl alcohol(Air Products) | 31 |
| Polyamino amid-epichlorohydrine adduct | 7 parts |
| Polyethylene oxide siloxane and surfactants | 2 parts |

Example-3

| | |
|---|---|
| Hydroxyethyl mathacrylate copolymer | 70 parts |
| Polyethyl oxazoline(r Polymer Chemicals and innovations) | 25 parts |
| Polyamino amid-epichlorohydrine adduct | 4 parts |
| Polyethylene oxide siloxane surfactants | 2 parts |

Example-4

| | |
|---|---|
| Polyethyl oxazoline | 50 parts |
| Polyvinyl alcohol | 42 parts |
| Polyamino amid-epichlorohydrine adduct | 6 parts |
| Poly siloxane and surfactants- | 2 parts |

Example 5

| | |
|---|---|
| Polyethyl oxazoline | 30 parts |
| Alumina Sol | 62 parts |
| Polyamino amid-epichlorohydrine adduct | 6 parts |
| Poly siloxane and surfactants- | 2 parts |

Opacifying Second Layer

Example-1

| | |
|---|---|
| Joncryl HPD-71(Supplier SC Johnson) | 42 parts |
| ISP 937(ISP products) | 20 parts |
| Film Kote Starch(National Starch) | 15 parts |
| Polyethylene imine(BASF) | 4 parts |
| Ammonium Polyacrylate(National Starch) | 16 parts |
| Surfactants | 3 parts |

Example-2

| | |
|---|---|
| Joncryl HPD-71 | 40 parts |
| Viviprint 121(ISP Products) | 15 parts |
| Film Kote Starch | 20 parts |
| Polyethylene imine | 5 parts |
| Ammonium Polyacrylate | 17 parts |
| Surfactants | 3 parts |

Example-3

| | |
|---|---|
| Joncryl HPD-71 | 35 parts |
| ISP 937 | 30 parts |
| Film Kote Starch | 10 parts |
| Polyethylene imine | 5 parts |
| Ammonium polyacrylate | 17 parts |
| Surfactants | 3 parts |

Example-4

| | |
|---|---|
| Joncryl HPD-71 | 35 parts |
| Viviprint 121 | 20 parts |
| Film Kote Starch | 20 parts |
| Polyethylene imine | 5 parts |
| Ammonium Polyacrylate | 17 parts |
| Surfactants | 3 parts |

In a typical example the two layered construction is as follows.

The coating formulation as depicted in example 2 of first layer coatings is layed onto the substrate using conventional coating techniques and dried in the oven ~65–100 degrees to obtain a clear coated substrate. The coat weight is ~6–18 gram/sq.meter(gsm). On top of the first layer is layed the second layer as depicted in example 2 of the second layer coatings. The conventional coating techniques used for first layer are used for the second layer coating as well. A typical coat weight ranges from 2 to 10 gsm. The second layer coating is dried gently the convert the two layered coating construction into an opaque or matte type of product.

Recording an Image on the Ink-Jet Recording Media

The ink-jet recording medium (metal foil laminated sheets coated with the two layers coated upon as described above were utilized to record an ink-jet image. A Hewlett Packard 850 inkjet printer was used to print an image onto at least one of each of the above types of the ink-jet recording media sheets. The recorded surface of the media was examined by touch for surface tackiness immediately upon printing and the surface was found to be substantially without tackiness. After allowing the printed sheet to develop for about 2 minutes at room temperature, a metal-looking holographic image was obtained.

Without further description, it is believed that one of ordinary skill in the art can, using the preceding description, make and utilize the compositions of the present invention and practice the claimed methods. The examples of coating compositions and methods as well as their proportions, specifically point out preferred embodiments of the present invention, and are not to be construed as limiting in any way the remainder of the disclosure. Such examples are non-limiting in that one of ordinary skill (in view of the above) will readily envision other permutations and variations on the invention without departing from the principal concepts. Such permutations and variations are also within the scope of the present invention.

What is claimed is:

1. A multi-layer opaque and matte ink-jet recording medium, suitable for recording images with dye and pigmented inks, which goes through phase change from opaque to transparent and glossy in at least one printed area to reveal the surface of a substrate and thereby provide light-emitting, reflective, glossy, metallic-looking images or to show holographic images, wherein the recording medium comprises a substrate coated with at least two chemically coupled layers comprising:

(a) a first transparent ink-receptive layer comprising a polymeric binder and a cross-linker and optionally having a plasticizer and pigment particles such as alumina and silica coated over the substrate, wherein:

(i) the cross-linker comprises a polyaminoamide epichlorohydrin resin, or a salt thereof, (ii) the cross-linker comprises an azetidinium polymerr salt comprising monomer units having the structural formula:

(I)

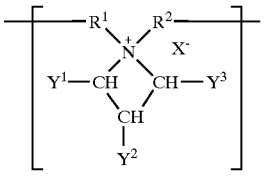

in which $R^1$ and $R^2$ are independently lower alkylene, X− is an anionic, organic or inorganic counterion, and $Y^1$, $Y^2$ and $Y^3$ are selected from the group consisting of hydrogen, hydroxyl, halo, alkoxy, alkyl, amino, carboxy, acetoxy, cyano and sulfhydryl, and (iii) the cross-linker may further comprise a polyfunctional aziridine or a salt thereof, or a polyfunctional oxazoline and metallic salts; and (b) a second ink-receptive layer comprising an opaque or semi-opaque coating composition, wherein the opaque or semi-opaque coating composition is capable of accepting a printed image and thereby becoming semi-transparent or clearly transparent from application of ink-jet printing ink or similar inks, while presenting a light-emitting, reflective, glossy, metallic-looking or holographic or transparent image of high clarity and quality, wherein said first layer is located between said second layer and the substrate in said recording medium and the first and second layer are chemically coupled.

2. A multi-layer opaque and matte ink-jet recording medium according to claim 1, wherein the cross-linker salt may comprise a ionic member selected from the group consisting of ammonium, zirconium, carbonate, boric acid or zinc chloride, and each of the layer may optionally contain one or more binders selected from the group consisting of starch derivatives, cellulosic derivatives, or polypeptides.

3. A multi-layer opaque and matte ink-jet recording medium according to claim 2, wherein the second ink-receptive layer comprises a polyacrylic acid salt, ethoxylated polyethylene amine, and/or polyethyleneimine and optionally one or more binders selected from the group consisting of a starch derivative, an acrylic binder or a vinyl polymeric binder.

4. An ink-jet recording medium according to claim 3, wherein the X−anion of the salt is a member selected from the group consisting of halide, hydrogen sulfate, acetate, methane sulfonate, succinate, citrate, malonate, fumarate, oxylate, gluconate or a gluconate derivative, and an azetidinium polymer salt is a homopolymer or a copolymer salt.

5. An ink-jet recording medium according to claim 4, wherein, in the azetidinium polymer salt, $R^1$ and $R^2$ are methylene, $Y^1$ and $Y^3$ are independently hydrogen or lower alkyl, and $Y^2$ is hydrogen or hydroxyl, and X− is a halogen anion.

6. The ink-jet recording medium according to claim 5, wherein $Y^1$ and $y^3$ are both hydrogen, $Y^2$ is hydroxyl.

7. The ink-jet recording medium of claim 6, wherein the polymers or polymer salts of the cross-linker of the first ink-receptive layer are soluble in an aqueous solvent or are soluble in an solvent mixture of an aqueous solvent and a polar organic solvent.

8. The ink-jet recording medium of claim 7, wherein the polar organic solvent is an alcohol.

9. The ink-jet recording medium according to claim 6, wherein the ink-jet recording medium is capable of accepting a printed image and presenting a metallic-looking image.

10. An ink-jet recording medium according to claim 6, wherein the opaque or semi-opaque coating composition in the second ink-receptive layer of the ink-jet recording medium comprises (a) an animonium salt of either a monomeric or polymeric polyacid that is produced by reaction of the acid with ammonia or a low volatile amine, and (b) either a monomeric or polymeric polybase, wherein the polyacid contains two or more carboxylic, sulfonic and/or phosphonic acid groups and the polybase contains two or more primary, secondary or tertiary amine groups.

11. An ink-jet recording medium according to claim 10, wherein the second ink-receptive layer comprises a single or multiple coatings of the opaque or semi-opaque coating composition that collectively provide a multilayer coating of the second ink-receptive layer on top of the first transparent ink-receptive layer coated substrate.

12. An ink-jet medium according to claim 11, wherein at least one opaque coating has been applied on top of the first coated transparent layer on the substrate to produce a multi-layer ink-receptive coated substrate.

13. The ink-jet recording medium according to claim 6, wherein the cross-linker of (a) in the first ink-receptive layer further comprises a polyfunctional aziridine or a salt thereof, or comprises a polyfunctional oxazoline or a salt thereof wherein the counter ion is at least one member selected from the group consisting halides, acetate, sulfonate.

14. The ink-jet recording medium of claim 13, wherein one or more of the first and second ink receptive layers also contains at least one polymer that is soluble in an aqueous solvent or in a solvent mixture of an aqueous solvent and a polar organic solvent and the polymer is a member selected from the group consisting of (a), (b), (c) or a combination thereof:

(a) 2-hydroxyethylmethacrylate/co-acrylic acid copolymer, 2-hydroxyethylmethacrylate/methacrylic acid copolymer, 2-hydroxyethyl-methacrylate/dimethylaminopropylmethacrylate, 2-hydroxyethyl-methacrylate/dimethylaminoethylmethacrylate, and 2-hydroxyethylmethacrylate-vinylpyrrolidone, quaternized polyhydroxyethylmethacrylate-co-dimethylaminoproplymethacrylat, quaternized polyhydroxyethlymethacrylate-co-dimethylamino-ethylmethacrylate;

(b) vinylpyrrolidone polymers and copolymers are selected from the group consisting polyvinylpyrrolidone vinylpyrrolidone/dimethylaminoethyl methacrylate copolymer, vinyl caprolatam/vinylpyrrolidone/dimethylaminoethyl methacrylate terpolymer, vinylcaprolatam/vinylpyrroldone/dimethylaminopropyl methacrylamide terpolymer, vinylpyrrolidone/dimethylaminopropyl methacrylamide copolymer, vinylpyrrolidone/dimethylaminoethyl methacrylate copolymer, and quaternized derivatives thereof, and (c) polyethyloxazoline.

15. The ink-jet recording medium of claim 13, wherein one or more of the first and second ink receptive layers further comprises a polymer that is water soluble, soluble in a mixed aqueous/organic solvent, or a polymer that is dispersible in such solvents, wherein the polymer is a member selected from the group consisting of partially or fully hydrolyzed polyvinyl alcohol and their derivatives, acrylic polymers, acrylic polymers, vinyl polymers, vinyl polymers, a polyurethane, and a mixture of at least two members thereof.

16. The ink-jet recording medium of claim 13, wherein each of the first and second layers may independently include a plasticizer which is a member selected from the group consisting of phosphates, substituted phthalic anhydrides, glycerols, and polyglycols.

17. The ink-jet recording medium of claim 16, wherein the plasticizer is polyethylene glycol or a derivative thereof.

18. The ink-jet recording medium of claim 13, wherein each of the first and second layers may independently further comprises solvent absorbing particles.

19. The ink-jet recording medium of claim 18, wherein each of the solvent absorbing particles are inorganic particles such as silica and alumina particles.

20. The ink recording medium of claim 13, wherein each of the first and second layers may independently further comprise organic particulates selected from the group consisting of starch, polyolefins, poly(methyl methacrylates), polystyrenes, polytetrafluoroethylenes, polyurethanes, and polyvinylpyrrolidone.

21. The ink-jet recording medium of claim 13, wherein each of the first and second layers may independently further comprise additives selected from the group consisting of anti-foam agents, surfactants, dyestuffs, optical brighteners, and mixtures thereof.

22. The ink-jet recording medium of claim 6, wherein the substrate is a paper substrate, a polymeric film substrate, a metallic reflective substrate, or a holographic substrate.

23. The ink-jet recording medium of claim 21, wherein the substrate is a paper selected from the group consisting of plain, clay-coated, resin-coated, and latex-saturated papers.

24. The ink-jet recording medium of claim 21, wherein the substrate is a transparent or opaque polymeric film selected from the group consisting of polyvinyl chloride, polyethylene, polypropylene, polycarbonate, polyimide, polyester, and fluoroplastic films.

25. The ink-jet recording medium of claim 23, wherein the coated substrate is glossy and opaque, transparent, translucent, matte, metallic, or opaque.

26. The ink-jet recording medium of claim 24, wherein one or more functional or non-functional coating layers are placed between the paper substrate and two coating layers (a) and (b).

27. A printed paper product prepared by a method comprising applying an ink composition to the ink-jet recording medium of claim 6, wherein the ink composition comprises an aqueous or organic solvent type dye that is capable of reacting with an opaque or semi-opaque ink receptive layer and changing it into a transparent or semi-transparent layer.

28. A printed paper product prepared by the method of claim 27, wherein the dye composition is a predominantly aqueous based ink or is an ink having a mixed solvent of at least one aqueous solvent and at least one aqueous miscible organic solvent.

29. A printed substrate product having one surface of the product comprising an adhesive backing that is optionally removable, wherein the printed substrate is prepared by a method comprising applying an ink composition to the ink-jet recording medium of claim 6, wherein the ink composition comprises an aqueous or organic solvent type dye that is capable of reacting with an opaque or semi-opaque ink receptive layer and changing it into a transparent or semi-transparent layer.

30. A printed paper product having one surface of the product comprising an adhesive backing that is optionally removable according to claim 29, wherein the dye composition is a predominantly aqueous based ink or is an ink having a mixed solvent of at least one aqueous solvent and at least one aqueous miscible organic solvent.

31. The ink-jet recording medium of claim 10, wherein the homopolymeric or mixed polymeric polyacid of the ammonium salt comprises one or more monomeric polyacid members selected from the group consisting of oxalic acid, maleic acid, succinic acid, methylsuccinic acid, malonic acid, adipic acid, glutaric acid, fumaric acid, dihydroxyfumaric acid, malic acid, mesaconic acid, itaconic acid, phthalic acid, isophthalic acid, tereplithalic acid, 1,2-, 1,3- and 1,4-cyclohexane dicarboxylic acids, 1,2,3-cyclohexane tricarboxylic acid, 1,2,4-cyclohexane tricarboxylic acid, 1,3,5-cyclohexane tricarboxylic acid, 1,2- and 1,3-cyclopentane dicarboxylic acids, citric acid, tartaric acid, dihydroxyterephthalic acid, 1,2,3-, 1,2,4- and 1,2,5-benzene tricarboxylic acids, tricarballylic acid, 1,2,4,5-benzene tetracarboxylic acid, norbornene tetracarboxylic acid, 3',4,4'-benzophenone tetracarboxylic acid, 1,2,3,4,5,6-benzene hexacarboxylic acid, aspartic acid, glutamic acid, and combinations thereof.

32. The ink-jet recording medium of claim 31, wherein the ammonium salt is obtained by reacting the homopolymeric or mixed polymeric polyacid with a low boiling point amines or ammonium.

33. The ink-jet recording medium of claim 32, wherein the polybase is a monomeric member selected from the group consisting of ethylenediamine, 1,2-propane diamine, 1,3-propanediamine, 1,2,3-triaminopropane, cis-1,2-cyclohexanediamine, trans-1,2-cyclohexanediamine, 1,3-bis(aminomethyl)cyclohexane, o-, m- and p-phenylenediamine, tetramethyl o-, m- and p-phenylenediamine, hexamethylene-iamine, hexamethylenetetraamine, diethylenetriamine, tetraethylenepentamine, pentaethylene-examine, pentamethyl diethylenetriamine, tris(2-aminoethyl)amine, 1,1,4,7,10,10-hexamethyl triethylenetetramine, tetramethyl-p-phenylenediamine, tetramethylethylenediamine, triethylenetetraamine, 4,4'-bipyridyl, and combinations thereof, or wherein the polybase is a homopolymer obtained containing one of the above monomeric polybases as monomeric polybase units or the polybase is a mixed polymer comprising two or more of the above monomeric polybase units.

34. The ink-jet recording medium of claim 33, wherein the monomeric polybase is selected from the group consisting of ethylenediamine, 1,2-propane diamine, 1,3-propanediamine, 1,2,3-triaminopropane, cis- 1,2-cyclohexanediamine, trans-12-cyclohexanediamine, 1,3-bis(aminomethyl)cyclohexane, o-, m- and p-phenylenediamine, tetramethyl o-, m- and p-phenylenediamine, hexamethylene-iamine, hexamethylenetetraamine, diethylenetriamine, tetraethylenepentamine, pentaethylene-examine, pentamethyl diethylenetriamine, tris(2-aminoethyl)amine, 1,1,4,7,10,1 0-hexamethyl triethylenetetramine, tetramethyl-p-phenylenediamine, tetramethylethylenediamine, triethylenetetraamine, 4,4'-bipyridyl, and combinations thereof.

35. The ink-jet recording medium of claim 23, wherein the polybase is polymeric.

36. The ink-jet recording medium of claim 35, wherein the polymeric polyacid of the ammonium salt is a carboxylic acid-containing polymer and the polymeric polybase comprises a nitrogenous polymer.

37. The ink-jet recording medium of claim 10, wherein the polymeric polyacid of the ammonium salt is selected from the group consisting of poly(acrylic acid), poly (acrylonitrile-acryl- ic acid), poly(styrene-acrylic acid), poly (butadiene-acrylonitrile acrylic acid), poly(butylacrylate-acrylic acid), poly(ethyl acrylate-acrylic acid), poly (ethylene-propylene-acrylic acid), poly(propylene-acrylic acid), alginic acid, phytic acid, and combinations thereof, and the polymeric polybase is selected from the group consisting of polyethyleneimine, polyvinylpyridine, polyallylamine (including N-alkylated and N,N-dialkylated polyallylamines), polyvinylaziridine, polyimidazole, polylysine, chitosan, poly(amino and alkylated amino) ethylenes, ethoxylated polyethyleneimine, propoxylated polyethyleneimine, and combinations thereof.

38. The ink-jet recording medium of claim 10, wherein the polyacid of the ammonium salt is monomeric and is a member selected from the group consisting of oxalic acid, maleic acid, succinic acid, methylsuccinic acid, malonic acid, adipic acid, glutaric acid, fumaric acid, dihydroxyfumaric acid, malic acid, mesaconic acid, itaconic acid, phthalic acid, isophthalic acid, terephthalic acid, 1,2-, 1,3- and 1,4-cyclohexane dicarboxylic acids, 1,2,3-cyclohexane tricarboxylic acid, 1,2,4-cyclohexane tricarboxylic acid, 1,3,5-cyclohexane tricarboxylic acid, 1,2- and 1,3-cyclopentane dicarboxylic acids, citric acid, tartaric acid, dihydroxyterephthalic acid, 1,2,3-1,2,4- and 1,2,5-benzene tricarboxylic acids, tricarballylic acid, 1,2,4,5-benzene tetracarboxylic acid, norbomene tetracarboxylic acid, 3,3',4,4'-benzophenone tetracarboxylic acid, 1,2,3,4,5,6-benzene hexacarboxyic acid, aspartic acid, glutamic acid, and combinations thereof, and wherein the polybase is a polymeric polybase member selected from the group consisting of polyethyleneimine, polyvinylpyridine, polyallylamine (including N-alkylated and N,N-dialkylated polyalklylamines), polyvinylaziridine, polyimidazole, polylysine, chitosan, poly(amino and alkylated amino) ethylenes, ethoxylated polyethyleneimine, propoxylated polyethyleneimine, and combinations thereof.

39. The ink-jet recording medium of claim 10, wherein the polyacid of the ammonium salt is a carboxylic acid-containing polymer selected from the group consisting of poly)(acrylic acid), poly(acrylonitrile-acryl-ic acid), poly (styrene-acrylic acid), poly(butadiene-acrylonitrile acrylic acid), poly(butylacrylate-acrylic acid), poly(ethyl acrylate-acrylic acid), poly(ethylene-propylene-acrylic acid), poly (propylene-acrylic acid), alginic acid, phytic acid, and combinations thereof, and the polybase is a monomeric polybase member selected from the group consisting of ethylenediamine, 1,2-propane diamine, 1,3-propanediamine, 1,2,3-triaminopropane, cis- 1,2-cyclohexanediamine, trans- 1,2-cyclohexanediamine, 1,3-bis(aminomethyl)cyclohexane, o-, m- and p-phenylenediamine, tetramethyl o-, m- and p-phenylenediamine, hexamethylenediamine, hexamethylenetetraamine, diethylenetriamine, tetraethylenepentamine, pentaethylenehexamine, pentamethyl diethylenetriamine, tris(2-aminoethyl)amine, 1,1,4,7,10,10-hexamethyl triethylenetetramine, tetramethyl-p-phenylenediamine, tetramethylethylenediamine, triethylenetetraamine, 4,4-bipyridyl, and combinations thereof.

40. The ink-jet recording medium of claim 10, wherein the opaque or semi-opaque coating composition is aqueous, and further includes a film-forming binder and inorganic particles or inorganic pigment.

41. The ink-jet recording medium of claim 37, wherein the colorant contains at least one pigment selected from the group consisting of silica, titanium dioxide, calcium silicate, calcium carbonate and alumina.

42. The ink-jet recording medium of claim 37, wherein the colorant contains an ink-jet recording medium compatible dye.

43. The ink-jet recording medium of claim 37, wherein an the opaque or semi-opaque coating agent represents approximately 5 wt. % to approximately 95 wt. % of the second ink-receptive layer, based upon total solids weight of the composition after drying.

44. The ink-jet recording medium of claim 40, wherein a film-forming binder represents approximately 1 wt. % to approximately 40 wt. % of the second ink-receptive layer, based upon total solids weight of the composition after drying.

45. The ink-jet recording medium of claim 40, wherein a film-forming binder represents approximately 1 wt. % to approximately 50 wt. % of the second ink-receptive layer, based upon total solids weight of the composition after drying.

46. The ink-jet recording medium of claim 40, wherein a film-forming binder represents approximately 1 wt. % to approximately 15 wt. % of the second ink-receptive layer, based upon total solids weight of the composition after drying.

47. The ink-jet recording medium of claim 40, wherein the opaque or semi-opaque coating composition contained in the of the second ink-receptive layer further includes an optical brightener in approximately 0.01 wt. % to approximately 20 wt. % of the opaque or semi-opaque coating composition.

48. The ink-jet recording medium of claim 40, wherein the opaque or semi-opaque coating composition contained in the of the second ink-receptive layer further includes a crosslinking agent selected from the group consisting of ammonium zirconyl carbonate zirconium acetate, and the surface of the substrate is reflective.

49. The ink-jet recording medium of claim 45, wherein the reflective surface has a metallic appearance.

50. The ink-jet recording medium of claim 46, wherein the wherein the substrate is a paper/foil laminate.

51. The ink-jet recording medium of claim 46, wherein the wherein the substrate is a metallized film.

52. The ink-jet recording medium of claim 46, wherein the wherein the reflective surface of the substrate is holographic.

53. The ink-jet recording medium of claim 46, wherein the pH of each the coating compositions to provide the transparent first ink-receptive layer and the second opaque layer is a pH between 7 and 12.

54. The ink-jet recording medium of claim 53, wherein the first transparent layer is coated upon a substrate at a dry coat weight of 4 to 30 grams per square meter.

55. The ink-jet recording medium of claim 53, wherein the second opaque layer is coated upon a substrate at a dry coat weight of 2 to 18 grams per square meter.

56. A multi-layer opaque and matte ink-jet recording medium, suitable for recording images with dye and pigmented inks, which goes through phase change from opaque to transparent and glossy in at least one printed area to reveal the surface of a substrate and thereby provide light-emitting, reflective, glossy, metallic-looking images or to show holographic images, wherein the recording medium comprises a substrate coated with at least two chemically coupled layers comprising:

(a) a first transparent ink-receptive layer comprising a polymeric binder and a cross-linker and optionally having a plasticizer and pigment particles such as alumina and silica coated over the substrate, wherein the cross-linker comprises an azetidinium polymer or a salt thereof, and/or a polyfunctional aziridine or a salt thereof, or a polyfunctional oxazoline and metallic salts; and (b) a second ink-receptive layer comprising an opaque or semi-opaque coating composition, wherein the opaque or semi-opaque coating composition is capable of accepting a printed image and thereby becoming semi-transparent or clearly transparent from application of ink-jet printing ink or similar inks, while presenting a light-emitting, reflective, glossy, metallic-looking or holographic or transparent image of high clarity and quality, wherein said first layer is located between said second layer and the substrate in said recording medium and the first and second layer are chemically coupled.

57. A multi-layer opaque and matte ink-jet recording medium according to claim 56, wherein the cross-linker salt may comprise a ionic member selected from the group consisting of ammonium, zirconium, carbonate, boric acid or zinc chloride, and each of the layer may optionally contain one or more binders selected from the group consisting of starch derivatives, cellulosic derivatives, or polypeptides.

58. A multi-layer opaque and matte ink-jet recording medium according to claim 57, wherein the second ink-receptive layer comprises a polyacrylic acid salt, ethoxylated polyethylene amine, and/or polyethyleneimine and optionally one or more binders selected from the group consisting of a starch derivative, an acrylic binder or a vinyl polymeric binder.

* * * * *